US011805810B2

(12) United States Patent
Hwang

(10) Patent No.: US 11,805,810 B2
(45) Date of Patent: Nov. 7, 2023

(54) COMBINABLE AND ORIENTABLE VAPING DEVICES

(71) Applicant: Next Level Ventures LLC, Seattle, WA (US)

(72) Inventor: Steven Hwang, San Rafael, CA (US)

(73) Assignee: Next Level Ventures LLC, Seattle, WA (US)

( * ) Notice: Subject to any disclaimer, the term of this patent is extended or adjusted under 35 U.S.C. 154(b) by 0 days.

(21) Appl. No.: 17/884,378

(22) Filed: Aug. 9, 2022

(65) Prior Publication Data

US 2022/0378092 A1 Dec. 1, 2022

Related U.S. Application Data

(63) Continuation of application No. 17/702,642, filed on Mar. 23, 2022.

(Continued)

(51) Int. Cl.

| | |
|---|---|
| ***A24F 40/30*** | (2020.01) |
| ***A24F 40/42*** | (2020.01) |
| ***A24F 40/485*** | (2020.01) |

(52) U.S. Cl.

CPC ..... *A24F 40/30* (2020.01); *A24F 40/42* (2020.01); *A24F 40/485* (2020.01)

(58) Field of Classification Search

None

See application file for complete search history.

(56) References Cited

U.S. PATENT DOCUMENTS 5,285,798 A 2/1994 Banerjee et al.
5,388,594 A 2/1995 Counts et al.

(Continued)

FOREIGN PATENT DOCUMENTS

CN 203505587 U 4/2014
CN 105167199 A 12/2015

(Continued)

OTHER PUBLICATIONS

"Double Barrel." Double Barrel, http://doublebarrel.com/. Accessed May 26, 2022.

(Continued)

*Primary Examiner* — James Harvey

(74) *Attorney, Agent, or Firm* — Dentons Durham Jones Pinegar; Sarah W. Matthews

(57) ABSTRACT

A vaping system includes a housing for selectively holding a first vaping device and a second vaping device. The first and second vaping devices each include a mouthpiece with a vapor outlet positioned towards a first edge. A first configuration within the housing spaces the vapor outlet of the first mouthpiece and the vapor outlet of the second mouthpiece by a first distance, and a second configuration within the housing spaces the vapor outlet of the first mouthpiece and the vapor outlet of the second mouthpiece by a second distance. The first distance is less than the second distance, the first configuration allowing the user to vape from the first and second vaping devices simultaneously and the second configuration allowing the user to separately vape from the first and second vaping devices. In another example, a connector with multiple configurations connects two or more vaping devices.

11 Claims, 11 Drawing Sheets

Related U.S. Application Data

(60) Provisional application No. 63/165,271, filed on Mar. 24, 2021.

(56) References Cited

U.S. PATENT DOCUMENTS

| | | | | |
|---|---|---|---|---|
| 10,111,470 | B2 | 10/2018 | Monsees et al. | |
| 10,653,180 | B2 | 5/2020 | Monsees et al. | |
| 11,241,037 | B2 | 2/2022 | Sweedler | |
| 2011/0265806 | A1 | 11/2011 | Alarson et al. | |
| 2013/0192615 | A1 | 8/2013 | Tucker et al. | |
| 2017/0027221 | A1 | 2/2017 | Liu | |
| 2018/0056015 | A1 | 3/2018 | Shwadchuck | |
| 2018/0199628 | A1* | 7/2018 | Sheng | A24F 40/42 |
| 2018/0213847 | A1 | 8/2018 | Reevell | |
| 2019/0082740 | A1 | 3/2019 | Verleur et al. | |
| 2019/0116886 | A1 | 4/2019 | Rostami et al. | |
| 2019/0314585 | A1 | 10/2019 | Rostami et al. | |
| 2019/0320716 | A1 | 10/2019 | Seidenfeld et al. | |
| 2019/0357596 | A1 | 11/2019 | Blick et al. | |
| 2020/0163382 | A1 | 5/2020 | Trzecieski | |
| 2020/0229492 | A1* | 7/2020 | Wilson | A24F 40/46 |
| 2020/0329780 | A1 | 10/2020 | Gatski | |
| 2021/0022396 | A1 | 1/2021 | Lee et al. | |
| 2021/0022399 | A1* | 1/2021 | Clough | A24F 40/42 |
| 2021/0161205 | A1* | 6/2021 | Grimm | A24F 13/14 |
| 2021/0227881 | A1 | 7/2021 | Bessant et al. | |
| 2022/0304375 | A1* | 9/2022 | Hwang | A24F 40/30 |
| 2022/0378092 | A1* | 12/2022 | Hwang | A24F 40/485 |

FOREIGN PATENT DOCUMENTS

| | | | |
|---|---|---|---|
| CN | 208002111 | U | 10/2018 |
| CN | 209594749 | U | 11/2019 |
| CN | 210017905 | U | 2/2020 |
| CN | 210184520 | U | 3/2020 |
| CN | 210184534 | U | 3/2020 |
| CN | 210445673 | U | 5/2020 |
| CN | 211129729 | U | 7/2020 |
| CN | 211558803 | U | 9/2020 |
| CN | 212368330 | U | 1/2021 |
| CN | 212437303 | U | 2/2021 |
| JP | 2001209438 | A | 8/2001 |
| WO | 2017167511 | A1 | 10/2017 |
| WO | 2020005695 | A1 | 1/2020 |
| WO | 2020097737 | A1 | 5/2020 |
| WO | 2020070262 | A1 | 9/2020 |

OTHER PUBLICATIONS

"Enovap Personal Vaporizer Plus." Enovap, https://www.enovap.com/en/vape-shop/vape-kit/ecigarette-enovap. Accessed May 26, 2022.

"Ezzy 2 in 1." Made-in-China: Connecting Buyers with Chinese Suppliers, https://m.made-in-china.com/product/Original-Ezzy-2-in-1-Dual-Oil-Chamber-Disposable-Vape-Bar-E-Cigarettes-with-900mAh-Battery-6ml-Pod-2000puffs-1907807132.html. Accessed Jun. 9, 2022.

"OVNS Duo Starter Kit." MVS: My Vapor Store, https://www.myvaporstore.com/OVNS-DUO-Starter-Kit-p/ovn-duo10.htm. Accessed May 26, 2022.

"Splif-E Dual Pod." Vape Passion, https://www.vapepassion.com/splif-e-dual-pod-vape-review/. Accessed May 26, 2022.

"Suorin Trio." Ecigclick, https://www.ecigclick.co.uk/suorin-trio-preview/. Accessed May 26, 2022.

"Tesla CP Couples Double Barrel 220W Starter Kit." Budget Vapors, https://www.budgetvapors.com/tesla-cp-couples-double-barrel-220w-starter-kit/. Accessed May 26, 2022.

"Yep Hell's Gate V2 Kit w/ Dual RDAs." Cheap Vaping, https://cheapvaping.deals/hells-gate-v2. Accessed May 26, 2022.

USPTO acting as International Searching Authority, "International Search Report and Written Opinion," International Application No. PCT/US2022/021561, dated Aug. 3, 2022.

* cited by examiner

COMBINABLE AND ORIENTABLE VAPING DEVICES

CROSS REFERENCE TO RELATED APPLICATION

A claim for priority to the Mar. 23, 2022 filing date of U.S. nonprovisional patent application Ser. No. 17/702,642, titled COMBINABLE AND ORIENTABLE ELECTRONIC VAPING DEVICES ("the '642 Nonprovisional application") is hereby made pursuant to 35 U.S.C. § 120; the '642 Nonprovisional application claims priority to the Mar. 24, 2021 filing date of U.S. Provisional Patent Application No. 63/165,271, titled COMBINABLE AND ORIENTABLE ELECTRONIC INHALATION DEVICES ("the '271 Provisional application"), pursuant to 35 U.S.C. § 119(e). The disclosures of the '642 Nonprovisional Application and '271 Provisional application are incorporated herein in their entireties.

FIELD OF THE INVENTION

This invention relates generally to the field of vaping devices (e.g., E-cigarettes and vaporizers), and more particularly, to combinable and orientable (e.g., reversible) vaping devices.

BACKGROUND

Various vaping devices, including electronic cigarettes (E-Cigarettes) and vaping devices (vaporizers), can be used to inhale different materials. Electronic vaping devices typically include a heater, batteries, a pre-vapor formulation (e.g., tobacco, an aerosol source, a flavor source, etc. or some combination thereof), and a mouthpiece. The batteries are often rechargeable from a wall outlet or USB port. The batteries power the heater, which in turn heats the pre-vapor formulation to its vaporizing point releasing inhalable vapors through the mouthpiece.

E-Cigarettes are marketed as a low-cost alternative to cigarette smoking and as having reduced harmful effects. As such, pre-vapor formulation used in E-Cigarettes typically includes nicotine. In many E-Cigarettes the pre-vapor formulation is included in a pre-filled cartridge requiring replacement when empty. In other E-Cigarettes (e.g., oil vaporizers) the pre-vapor formulation (e.g., e-juice or e-liquid) is contained in a pre-filled reservoir. When using pre-filled cartridges or reservoirs, nicotine concentration of the pre-vapor formulation is typically fixed. Some E-Cigarettes are designed to be disposable and are not re-fillable.

SUMMARY OF DISCLOSURE

According to one aspect, a housing for selectively holding a first vaping device and a second vaping device includes the first vaping device comprising a first mouthpiece with a vapor outlet positioned towards a first edge of the first mouthpiece, and the second vaping device comprising a second mouthpiece with a vapor outlet positioned towards a first edge of the second mouthpiece. The first vaping device and the second vaping device may have a first configuration within the housing, with the vapor outlet of the first mouthpiece and the vapor outlet of the second mouthpiece spaced apart by a first distance. The first vaping device and the second vaping device may also have a second configuration within the housing, with the vapor outlet of the first mouthpiece and the vapor outlet of the second mouthpiece spaced apart by a second distance, where the first distance is less than the second distance, the first configuration allows a user to vape from the first and second vaping devices simultaneously and the second configuration allows the user to separately vape from the first and second vaping devices.

In some examples, vapor from the first vaping device and vapor from the second vaping device mix when the user vapes from the first and second vaping devices in the first configuration. In other examples, the vapor outlet of the first mouthpiece and the vapor outlet of the second mouthpiece form a unitary vapor outlet in the first configuration.

According to another aspect, the housing includes a magnet for connecting the housing to a surface. In some examples the housing for selectively holding the first vaping device and the second vaping device comprises a void formed in a proximal end, the void sized to receive the first vaping device and the second vaping device.

According to another aspect, a cap can be provided for covering the first mouthpiece. The cap may cover at least a portion of the housing and the first mouthpiece. Two caps can be provided, one for covering a portion of the first mouthpiece and one for covering a portion of the second mouthpiece.

According to another aspect, a vaping system includes a first vaping device having a first mouthpiece; a second vaping device having a second mouthpiece, and a connector connecting the first vaping device and the second vaping device in multiple configurations. In some embodiments, the connector has a first configuration allowing the first vaping device to be connected to the second vaping device such that the first mouthpiece is adjacent to the second mouthpiece to allow a user to simultaneously draw from the first vaping device and the second vaping device. In some embodiments, the connector has a second configuration allowing the first vaping device to be connected to the second vaping device such that the first mouthpiece is not adjacent to the second mouthpiece to allow the user to draw from the first vaping device and the second vaping device separately. The connector may have a third configuration disconnecting the first vaping device from the second vaping device.

According to another aspect, the vaping system can include a second connector with multiple configurations, the second connector for connecting the second vaping device and a third vaping device in multiple configurations, with the third vaping device having a third mouthpiece. The second connector can have a first configuration allowing the second vaping device to be connected to the third vaping device such that the second mouthpiece is adjacent to the third mouthpiece to allow a user to simultaneously draw from the third vaping device and the second vaping device. The second connector can have a second configuration allowing the second vaping device to be connected to the third vaping device such that the third mouthpiece is not adjacent to the second mouthpiece to allow the user to draw from the third vaping device and the second vaping device separately. In some examples the connector comprises at least one of: a magnet, a slot, a friction fit connector, or a twist connector.

According to another aspect, the connector is integral to a body of the first vaping device, and/or a body of the second vaping device. In one exemplary configuration the body of the first vaping device comprises a substantially flat side in connection with a magnet, and the body of the second vaping device comprises a substantially flat side in connection with a magnet. In the first configuration, the substantially flat side of the first vaping device is magnetically connected to the substantially flat side of the second vaping device.

According to another aspect, the first configuration allows a user to simultaneously draw from the first vaping device and the second vaping device, where a first, proximal end of the first vaping device is connected to the first, proximal end of the second vaping device. The second configuration allows the user to draw from the first vaping device and the second vaping device separately, where the first, proximal end of the first vaping device is connected to a second, distal end of the second vaping device.

According to yet another aspect, a vaping system comprises: a vaping device having a body extending between a first end and a second end, the first end having a mouthpiece; and the body has a substantially planar side having a magnet for attaching the substantially planar side of the body to another surface.

The system can also include a second vaping device having a body extending between a first end and a second end. The magnet for attaching the substantially planar side of the body to another surface comprises a magnet for attaching the substantially planar side of the body to the second vaping device in multiple configurations. The magnet can have a first configuration allowing the vaping device comprising a first mouthpiece to be connected to the second vaping device comprising a second mouthpiece such that the first mouthpiece is adjacent to the second mouthpiece to allow a user to simultaneously draw from the vaping device and the second vaping device. Additionally, the magnet can have a second configuration allowing the vaping device to be connected to the second vaping device such that the first mouthpiece is not adjacent to the second mouthpiece to allow the user to draw from the vaping device and the second vaping device separately.

BRIEF DESCRIPTION OF DRAWINGS

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention. The components in the drawings are not necessarily to scale relative to each other. Like reference numerals designate corresponding parts throughout the several views.

DETAILED DESCRIPTION

Users of vaping devices can customize their vaping experience in a variety of ways. Users can create custom pre-vapor formulations, use different vaping devices for vaporizing different pre-vapor formulations, use vaping devices implementing different vaporizing techniques (conduction or convection), etc. Even with such vaping option variety, users continue to search for additional vaping device customization techniques and increasingly customized vaping experiences. However, some components of electronic vaping devices are not configurable and/or interchangeable with other electronic vaping devices. In fact, companies often create proprietary device components, proprietary pre-vapor formulations, etc. to lock users into their brand(s).

Aspects of the disclosed invention include combinable and orientable (e.g., reversible) vaping devices. In this description and the following clams, "vaping devices" are defined to include any device (including vaporizers and E-cigarettes) configured to energize a heating element to create heat and where the created heat is used (e.g., through conduction or convection) to transform a pre-vapor formulation into an inhalable vapor. Pre-vapor formulation is defined to include e-juice, e-liquid, oils, tobacco, dry herbs, botanical herbs, etc. A vaping device can also be a cartridge and not necessarily capable of being vaped without connection to one or more of a battery, a heating element, an atomizer, a mouthpiece, etc.

A vaping device can include a mouthpiece that is biased off center towards one edge of the vaping device. In one aspect, external dimensions of a vaping device approximate a cuboid (i.e., a three-dimensional rectangle). A mouthpiece is included on a face at one end of the cuboid. The mouthpiece is biased off center towards one edge of the face. In other configurations, the mouthpiece is not biased towards one edge of the face, but is positioned centrally.

In one aspect, a container is configured to accept multiple vaping devices. The vaping devices can be similarly configured, for example, as the described cuboid. The common container can be configured to accept electronic vaping devices in different orientations. For example, the common container can be configured to accept vaping devices with a mouthpiece oriented towards an edge of the common container or with a mouthpiece oriented towards the center of the common container. In one aspect, a common container is configured to accept cuboid shaped electronic vaping devices in a side-by-side arrangement. Parts that are described as being positioned "towards each other" means that they are closer to each other than they are to neighboring elements.

Figure 1:
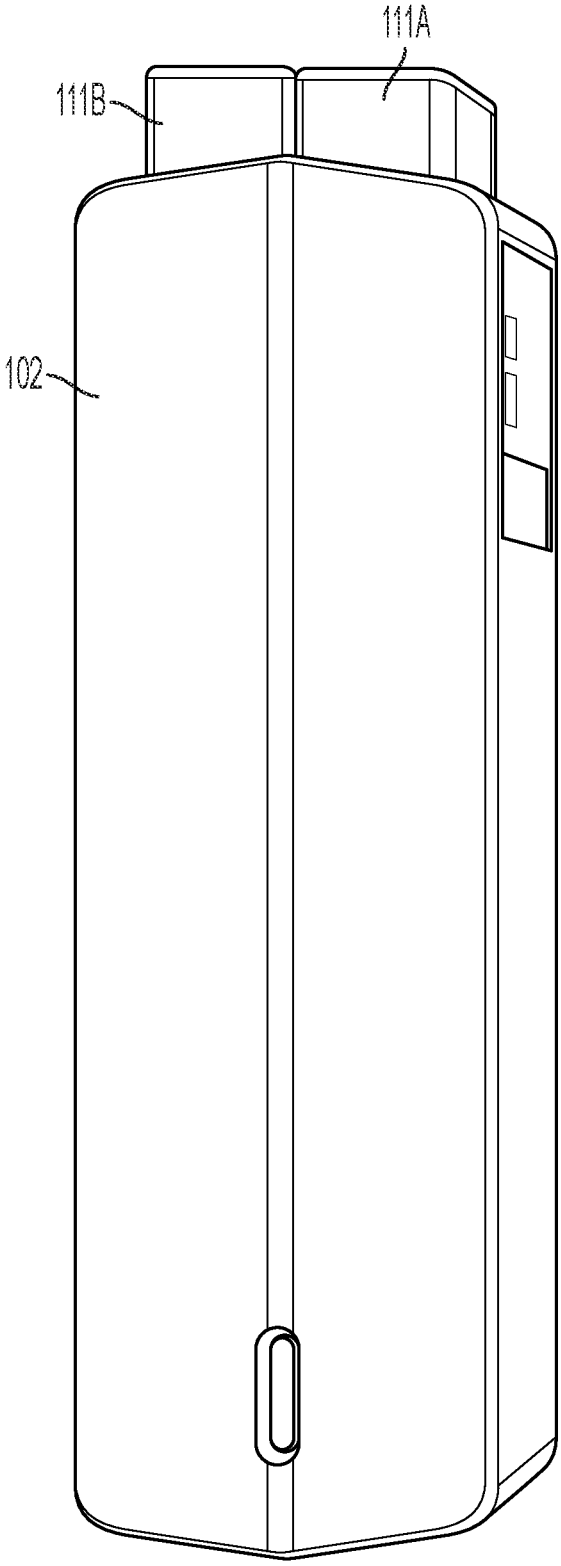
FIG. 1 is a perspective view of a vaping system according to various examples.
Figure 2:
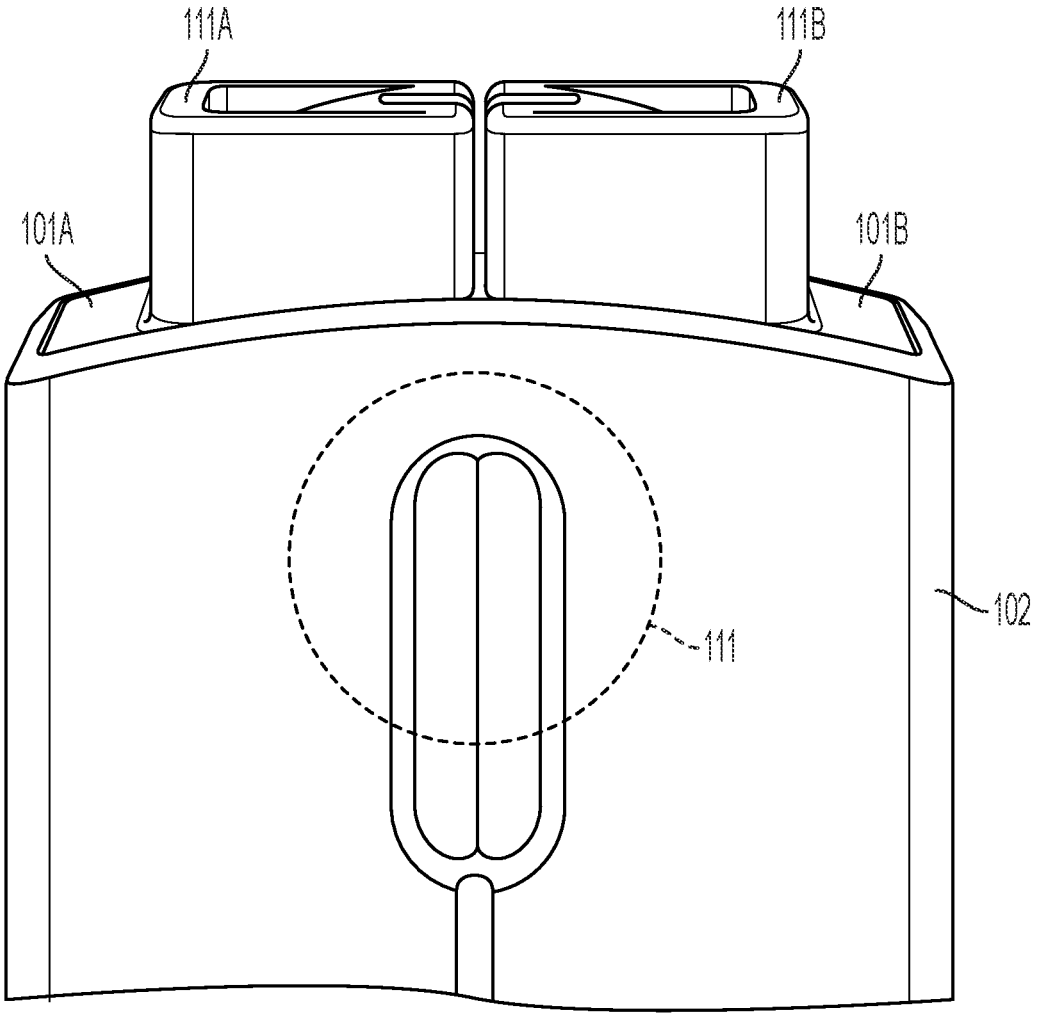
FIG. 2 is a perspective view of the proximal end of the vaping system of FIG. 1.

FIG. 1 depicts two vaping devices, 101A and 101B, in a side-by-side arrangement within a container or housing 102. As depicted, the mouthpieces 111A and 111B of the vaping devices 101A and 101B, respectively, are visible. FIG. 2 depicts vaping devices 101A and 101B in more detail. FIG. 2 also depicts a reservoir window 111 permitting viewing of a level of the pre-formulation material in the reservoirs of the vaping devices 101A and 101B. As depicted in FIGS. 1 and 2, mouthpieces 111A and 111B are oriented towards the center of the housing 102. As such, a user can simultaneously inhale vapors from both vaping devices 101A and 101B. Simultaneously vapor inhalation provides an additional mixing technique for customized vaping experiences.

Figure 3:
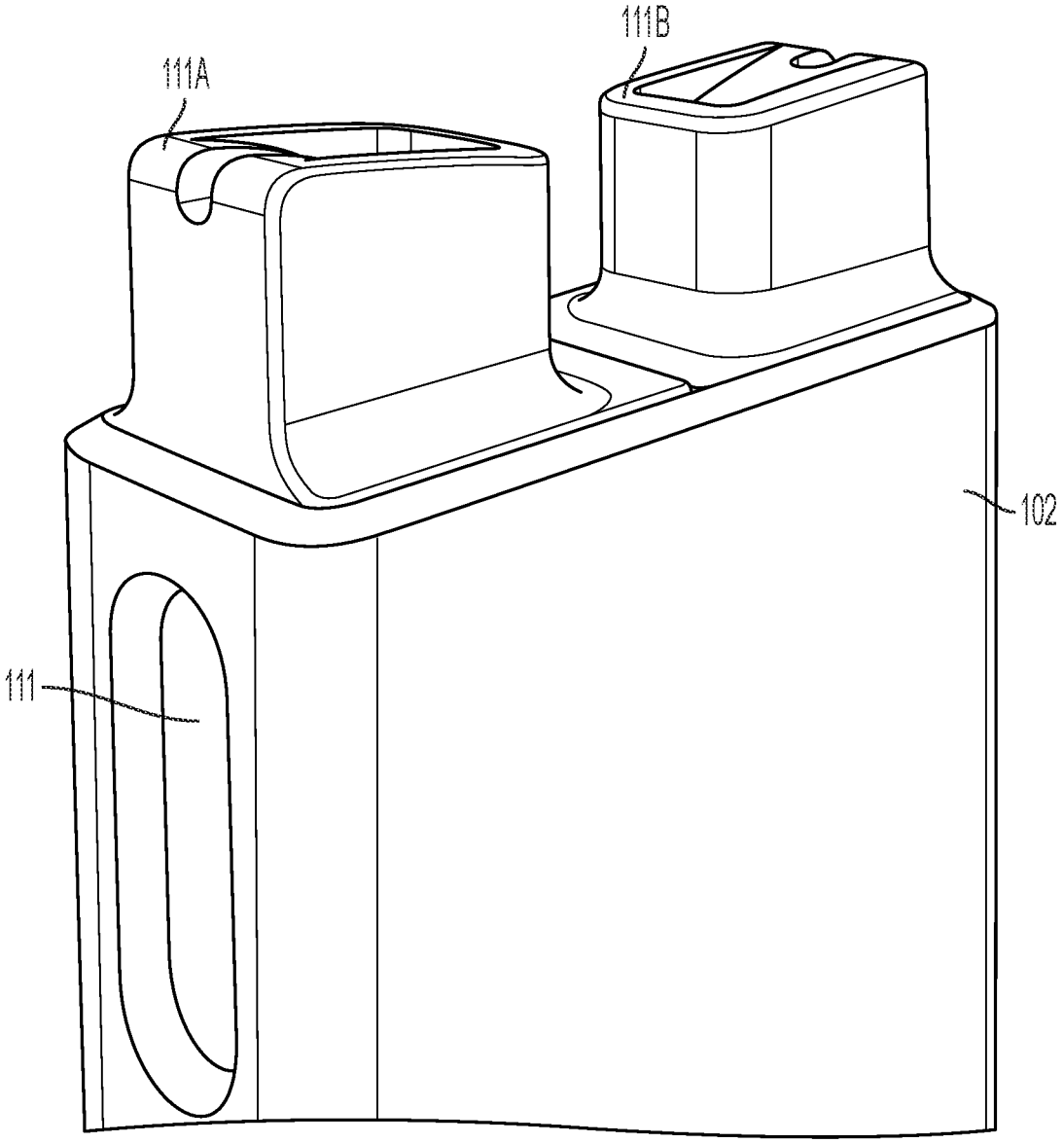
FIG. 3 is a perspective view of a vaping system according to various examples.

FIG. 3 depicts two evaping devices in another side-by-side arrangement within the housing 102. As depicted in FIG. 3, mouthpieces 111A and 111B are oriented towards the edges of the housing 102, or away from the center of the housing 102. As such, a user can inhale vapors from the vaping device 101A and the vaping device 101B separately. Separate vapor inhalation, from among multiple readily available inhalation sources in a common carrier, provides an additional technique for customized vaping experiences. Also illustrated in FIG. 3 is an optional side reservoir window 111. Reservoir window 111 may be placed on a front of the housing 102, on a side, towards the bottom, or towards the top of the housing 102, as desired. In other configurations, a reservoir window 111 is not provided.

Each vaping device 101A and 101B can be a standalone vaping device, such as, for example, a vaporizer or an e-cigarette, including a power source, heating element, a quantity of pre-vapor formulation, and a mouthpiece. In other configurations, each vaping device comprises a quantity of pre-vapor formulation with a vaporizer, and the power source is located within the housing 102. These types of vaping devices are commonly known as pods. Or each vaping device 101A, 101B can be a cartridge for connection to a power source.

In general, vaping devices (e.g., 101A and 101B) can be of the same, similar, or different form factors and can be mixed, matched, and/or oriented in accordance with user desires to customize the user's vaping experience. For example, different types of vaporizers can be included in a side-by-side arrangement in housing 102. One vaporizer can be an oil-based vaporizer and the other vaporizer can be herb-based vaporizer, both vaporizes can be oil-based vaporizers, etc. In one aspect, one vaping device is a vaporizer and the other vaping device is an e-cigarette. In other examples, the vaping devices 101A and 101B are identical in form factor but contain different flavors of pre-vapor formulation so a user can mix and match the flavors to customize their vaping experience.

In some examples, the system also includes carriers that can receive more than two (e.g., 4 or 6) vaping devices. The vaping devices can include a common, for example, cuboid form factor, or may be of variable form factors. Different combinations of mouthpieces can be oriented for simultaneous inhalation and/or separate inhalation. For example, two mouthpieces can be oriented for simultaneous inhalation while two other mouthpieces are oriented for separate inhalation.

Other aspects of the invention include mechanisms and techniques to connect vaping devices together outside of a carrier or housing. For example, vaping devices can be configured with components facilitating direct connection to one another. Vaping devices can include both protrusions and protrusion receptacles. The protrusions on one vaping device can be inserted into the protrusion receptacles on another vaping device and/or vice versa (e.g., in a "lego" type manner). Vaping device orientation can be selected such that corresponding mouthpieces are adjacent (facilitating simultaneous inhalation) or separate from one another (facilitating multiple readily available but separate inhalation sources). In another configuration described in more detail below, one or more vaping devices may be connectable via magnets.

Figure 4:
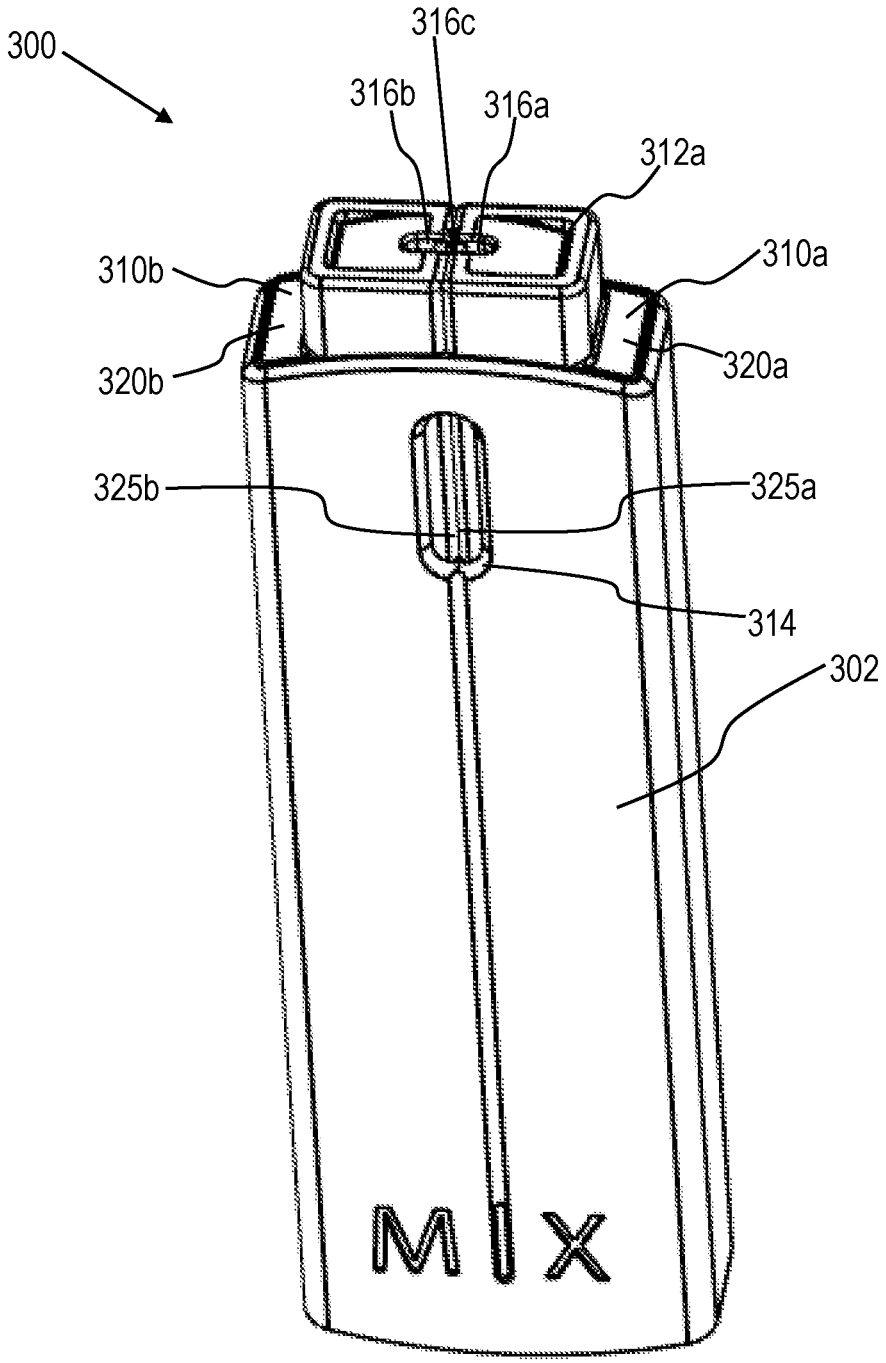
FIG. 4 is a perspective view of another vaping system according to various examples.
Figure 5:
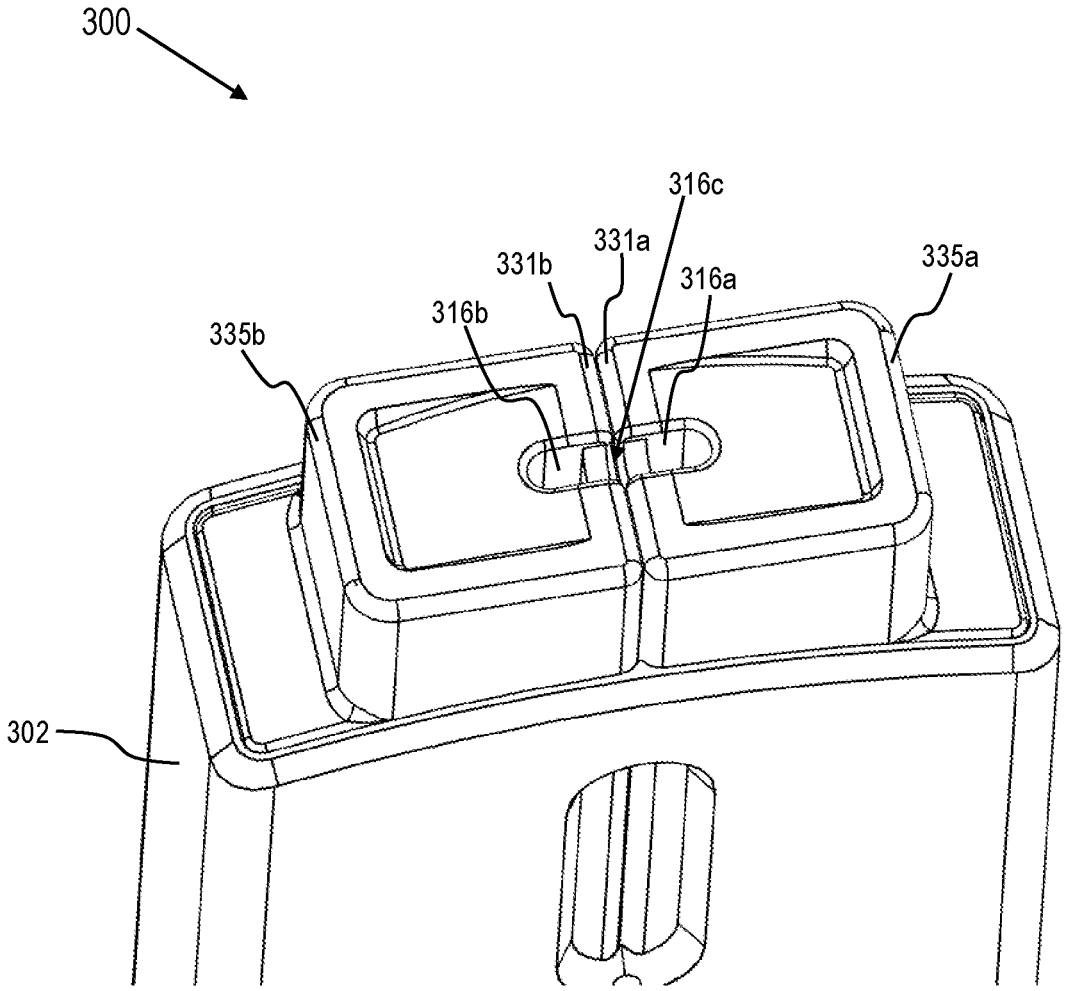
FIG. 5 is a perspective view of the proximal end of the vaping system of FIG. 4.

FIGS. 4-5 show another configuration of a vaping system 300. The vaping system 300 includes a housing 302, for housing one or more vaping devices. For example, two, three, or four or more vaping devices can be positioned within housing 302. In one exemplary configuration, two vaping devices 310*a* and 310*b* can be positioned within housing 302 and the housing 302 is shaped and sized to receive two electronic vaping devices in a side-by-side configuration.

Housing 302 may have a generally open proximal end with a void to selectively receive two or more vaping devices (e.g., vaping devices 310*a*, 310*b*, etc.). Electronic vaping devices may be stand-alone devices, or the electronic vaping devices may rely on a battery or power source within the housing 302 (i.e., pods). With a generally open proximal end of the housing 302, one or more vaping devices can be placed or removed by simply inserting the device into the void of the open proximal end without the need for removing any other cap or mouthpiece. The vaping devices may be held in place, for example, by friction fit, snap-fit, etc., to removably connect the electronic vaping devices to the interior of housing 302.

In some examples, housing 302 can include a battery or power source for providing power to vaping devices 310. Housing 302 can include one or more viewing windows 314. In other configurations, housing 302 does not include a viewing window 314.

In some configurations the body 320 of the vaping device 310 has at least one plane of symmetry, such that it can be placed into the housing 302 in at least two different ways. In some examples the body 320 is rectangular. This allows the body 320 of the vaping device 310 to be placed into the housing 302 with a first edge 331 towards the middle of the housing 302 (FIG. 5), or to be placed into the housing 302 with a first edge 331 away from the middle of the housing 302. As explained in more detail below, this gives the user the option of various configurations for separate or simultaneous vaping from the first and second vaping devices 310*a*, 310*b*.

The first vaping device 310*a* comprises a first mouthpiece 312*a*, and the second vaping device 310*b* comprises a second mouthpiece 312*b*. The mouthpiece 312*a,b* extends upwardly from the body 320 of the vaping device 310*a*, 310*b*, and are typically placed at least partially within the user's mouth when the user inhales or vapes from the vaping device 310a, 310*b*. The mouthpiece 312*a,b* can be formed integrally with the body 320 of the vaping device 310*a*, 310*b* or can be attached to a proximal end of the body 320 of the vaping device 310*a*, 310*b*.

Mouthpieces 312*a,b* may be centered relative to the body 320*a,b* of the vaping device 310*a,b*. Or, as shown in FIGS. 4-5, the mouthpiece 312*a,b* may be positioned closer to a first edge 325*a,b* of the body 320*a,b* of the vaping device 310*a,b*.

First mouthpiece 312*a* and second mouthpiece 312*b* include a vapor outlet, 316*a* and 316*b*, respectively, positioned on the mouthpiece 312*a*, 312*b*. Vapor outlet 316*a,b* is in fluid communication with the vaporizer or atomizer of the vaping device 310*a*, 310*b*, such that when a user places their mouth on the mouthpiece 312*a,b* and inhales at the vapor outlet 316*a,b* they inhale vapor through the vapor outlet 316*a,b* created by the pre-vapor formulation contacting the vaporizer of the vaping device 310*a*, 310*b*.

Similar to various placements for the mouthpiece 312*a*, 312*b* relative to the vaping device body 320*a*, 320*b*, the vapor outlet 316*a,b* may be placed at any suitable location on the mouthpiece 312*a,b*. In some configurations, the vapor outlet 316*a,b* is positioned off-center, or closer to one edge of the mouthpiece 312*a*, 312*b* than another edge of the mouthpiece 312*a*, 312*b*. In other configurations, the vapor outlet 316*a,b* is positioned in the center of the mouthpiece 312*a*, 312*b* or proximal to the center of the mouthpiece 213*a*, 312*b* (i.e., closer to the center of the mouthpiece than an edge of the mouthpiece). Or vapor outlet 316*a* can be positioned centrally on mouthpiece 312*a* and vapor outlet 316*b* can be positioned towards an edge of mouthpiece 312*b*.

As best seen in the exemplary configuration of FIG. 5, the first mouthpiece 312*a* has a vapor outlet 316*a* positioned towards a first edge 331*a* of the first mouthpiece 312*a*, and the second mouthpiece 312*b* has a vapor outlet 316*b* positioned towards a first edge 331*b* of the second mouthpiece 312*b*. Even more specifically, the vapor outlet 316*a* extends from the first edge 331*a* toward a second edge 335*a*, with the second edge 335*a* opposite the first edge 331*a*. Similarly, the vapor outlet 316*b* extends from the first edge 331*b* towards a second edge 335*b*.

With the vapor outlet 316 and/or the mouthpiece 312 positioned towards one side of the vaping device 310, various potential configurations for simultaneous or separate vaping are possible. For example, a first, combined orientation within the housing 302 includes the vapor outlet 316*a* of the first mouthpiece 312*a* and the vapor outlet 316*b* of the second mouthpiece 312*b* positioned towards each other or positioned toward a center of the housing 302. In the first, combined orientation, the first edge 331*a* of the first vaping device can abut the first edge 331*b* of the second vaping device. In configurations with each of the vapor outlets 316*a,b* positioned towards a first edge 331*a,b*, in the first, combined orientation, the vapor outlet 316*a* of the first electronic vaping device 310*a* can abut the vapor outlet 316*b* of the second electronic vaping device 310*b* and form a unitary vapor outlet 316*c*. In other words, the vapor outlets 316*a,b* can be in fluid communication such that when a user inhales, the vapor from each outlet 316*a,b* mixes.

In other configurations, the mouthpiece 312 and/or vapor outlets 316 of the vaping devices 310 are asymmetrically positioned, but the vapor outlets 316 do not form a unitary outlet in the first, combined configuration. Or, the mouthpiece 312 and/or vapor outlets 316 of the vaping devices 310 are centrally or symmetrically positioned, the vaping devices 310 have mouthpieces 312 and/or vapor outlets 316 that are centrally located. Alternatively, one of the vaping devices 310 may have a centrally positioned mouthpiece 312 and/or vapor outlet 316 , and one of the vaping devices 310 may have a mouthpiece 312 and/or vapor outlet 316 positioned toward an edge. Many configurations and combinations are contemplated.

A second, separated configuration within the housing 302 is possible with one or more of the vapor outlet(s) 316 of the first mouthpiece 312*a* and the vapor outlet(s) 316 of the second mouthpiece 312*b* positioned away from each other. For example, each of the two vaping devices 310*a*, 310*b* can be rotated 180 degrees relative to their position in the first, combined configuration. In other words, each of the vapor outlets 316*a*, 316*b* are positioned toward an edge of the housing 302 rather than toward a center of the housing 302. In configurations with asymmetric mouthpieces 312 and/or vapor outlets 316 , each may be positioned away from one another in this configuration. Alternatively, just one vaping device 310 can be rotated such that it is apart from the other electronic vaping device 310 . That is, the second, separated configuration can have at least one of the first vaping device 310*a* and second vaping device 310*b* positioned away from the center of the housing 302.

Figure 6A:
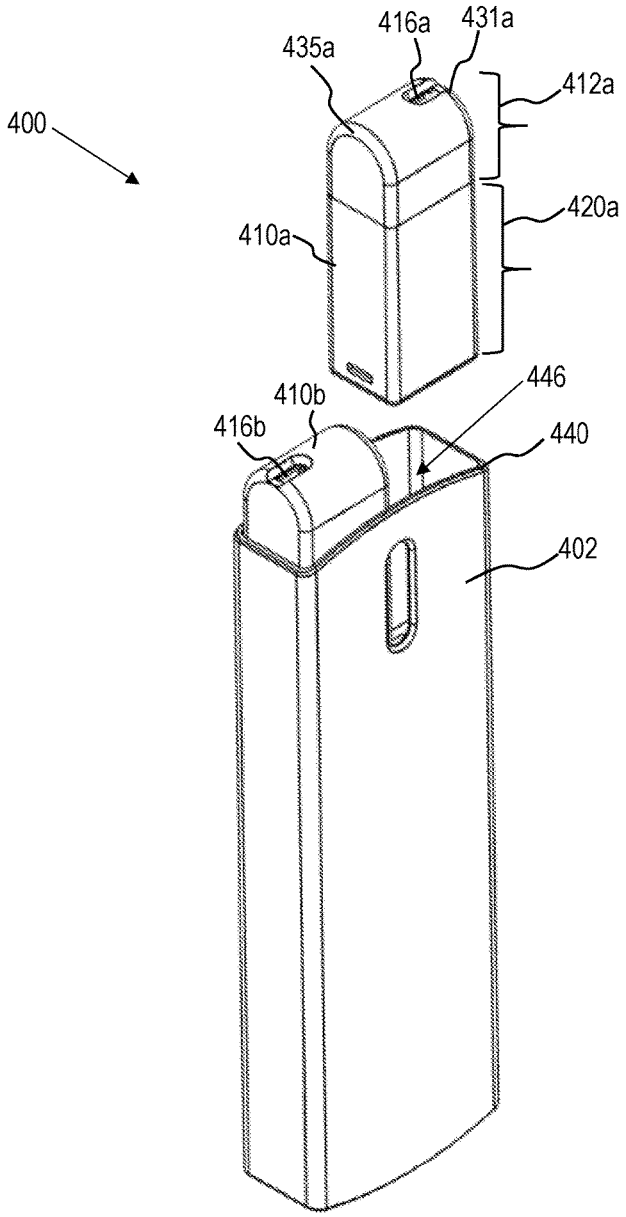
FIG. 6A is an exploded, perspective view of a vaping system according to various examples.
Figure 6B:
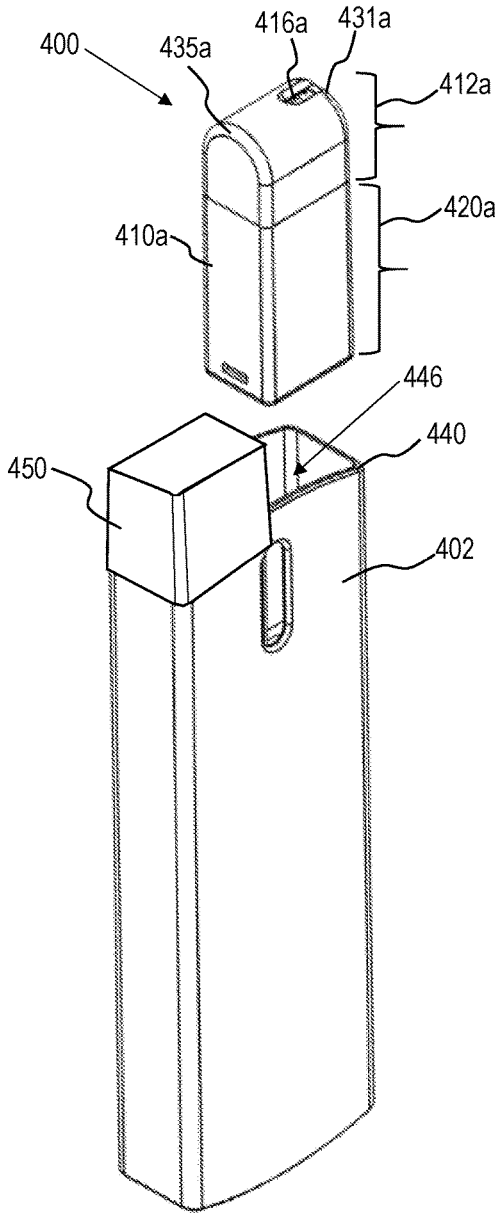
FIG. 6B is an exploded, perspective view of a vaping system showing an optional exemplary cap.
Figure 7:
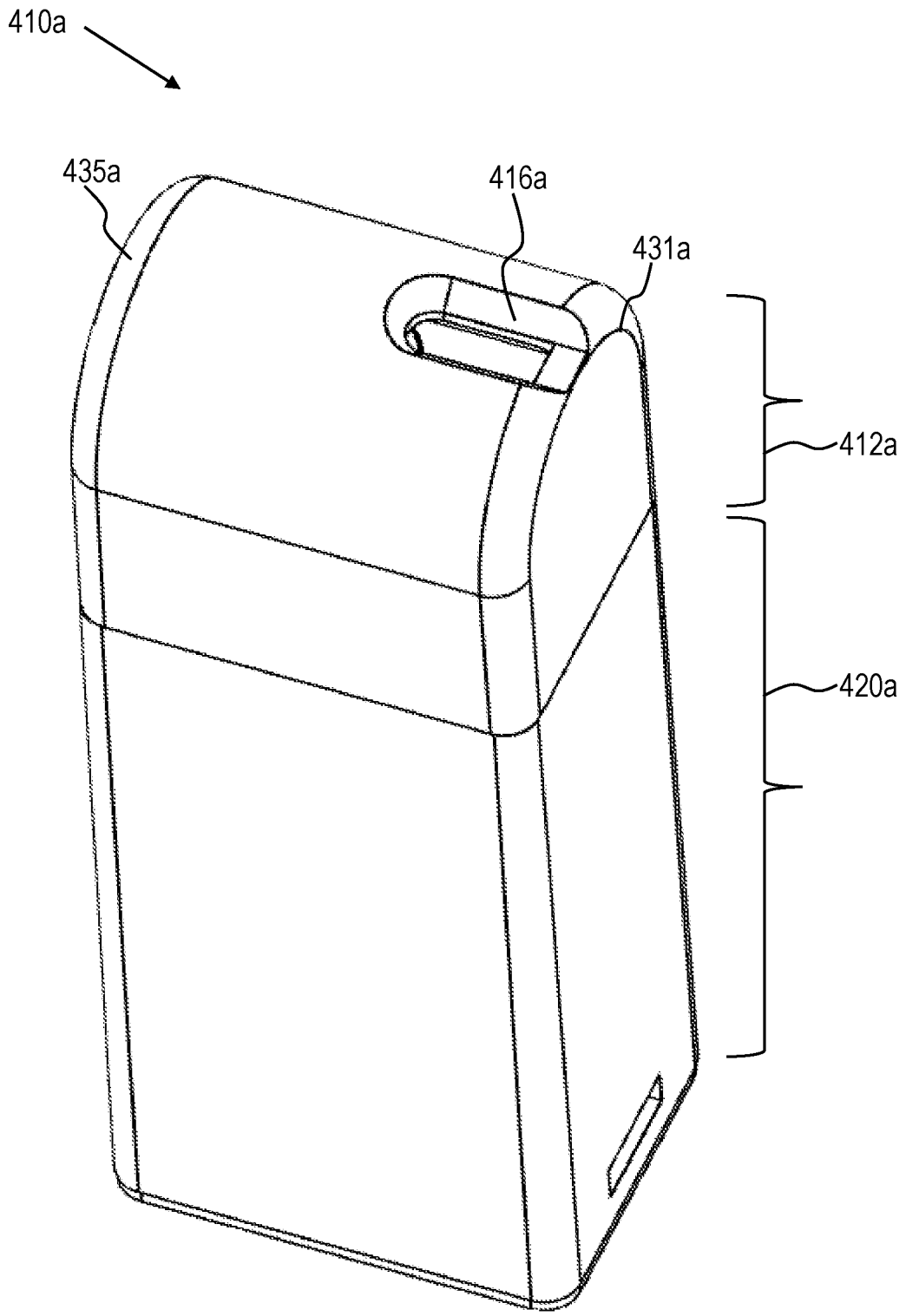
FIG. 7 is a perspective view of a vaping device according to various examples.

FIGS. 6A and 6B, and illustrate another configuration of a vaping system 400. First vaping device 410*a* and second vaping device 410*b* can be selectively placed in the housing 402. As seen in FIG. 6A, housing 402 includes an open proximal end 440 with a void 446 for receiving at least two (or more, in some configurations) vaping devices 410. Void 446 can be shaped and sized to fit two electronic vaping devices 410*a*, 410*b* side-by-side. Void 446 can be substantially open and in some examples, void 446 lacks any additional structures. This allows simple placement and removal of electronic vaping devices 410. Similarly, the system 400 can lack a lid or other over-structure to ease in placement and removal of electronic vaping device 410s. Or in other configurations a lid or cap can be provided.

First vaping device 410*a* includes a body 420*a* and a mouthpiece 412*a* with a vapor outlet 416*a*. The vapor outlet 416*a* of the first vaping device 410*a* extends from a first edge 431*a* toward a second edge 435*a* of the first mouthpiece 412*a*, where the second edge 435*a* is opposite the first edge 431*a*.

Similar to the configurations described above, the system 400 has a first, combined orientation with the vapor outlets 416*a* and 416*b* positioned towards each other. A second, separated configuration of the vaping devices 410*a* and 410*b* within the housing 402 occurs with the vapor outlet 416*a* of the first mouthpiece 412*a* and the vapor outlet 416*b* of the second mouthpiece 412*b* positioned away from each other. This can be done by turning the first vaping device 410*a* and/or the second electronic vaping device 410*b* 180 degrees relative to their position in the first, combined configuration.

FIG. 6B illustrates an exemplary cap 450 that can be placed over one of the vaping devices 410. In some examples, a single cap 450 is provided that covers one of the vaping devices 410. In other examples, two caps can be provided to cover both vaping devices 410*a*, 410*b*. One or more caps 450 can allow a user to vape from one vaping device 410 at a time, and can then be removed to allow the user to vape from both vaping devices 410 simultaneously.

In other configurations, rather than seating two vaping devices into a single housing, two vaping devices may be connected to each other. Various ways of connecting two electronic vaping devices are possible, such as through snap fit, friction fit, mating projections and voids, slots, magnets, etc. In the exemplary configurations show in in FIGS. 8-11, two vaping devices are magnetized together. In other configurations, one or more connectors can be used to connect two or more vaping devices. For example, two connectors can be used to connect three vaping devices. The connections can be linear (i.e., daisy-chained), or non-linear, and multiple configurations are possible for two devices, three devices, or four or more devices to be connected. The connector(s) can be a magnet, a snap-fit connector, a friction fit connector, mating projections and voids, slots, etc., or a combination thereof.

Figure 8:
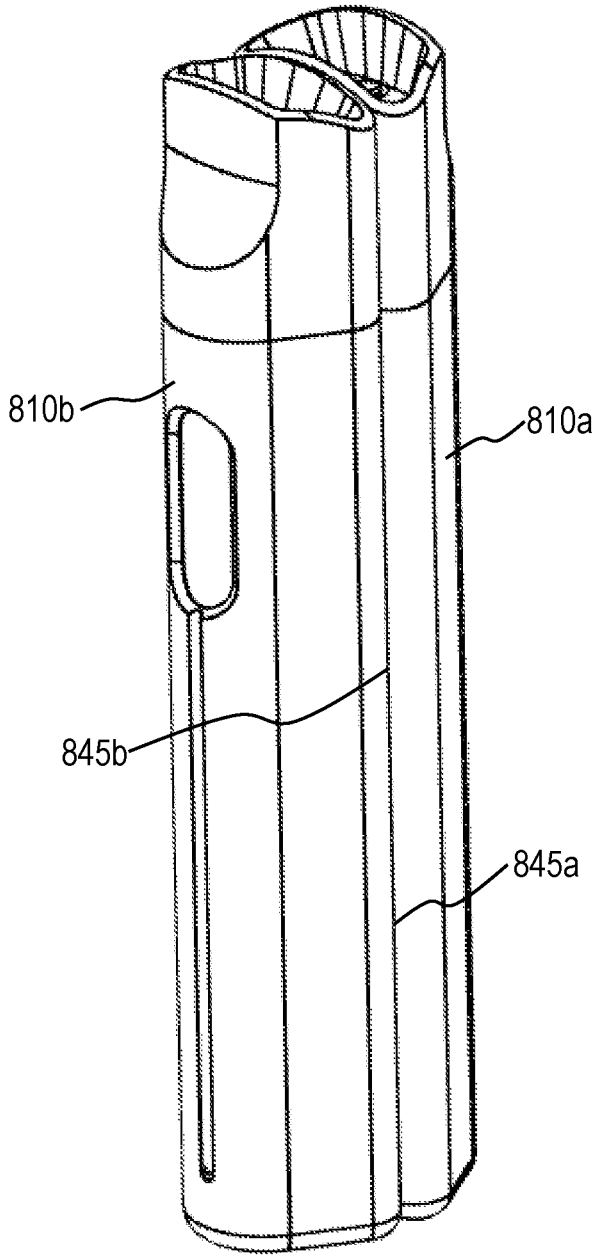
FIG. 8 is a perspective view of another vaping system according to various examples.

For example, in FIG. 8, the system includes a first vaping device 810*a* magnetized to a second vaping device 810*b*. Each vaping device 810*a,b* includes at least one magnetized side 845*a,b*. Or in other configurations one device can include a magnetized side and the second device can include a side capable of being attached to a magnet or capable of attracting a magnet. Two electronic vaping systems 810*a* and 810*b* are magnetized together in FIG. 8. A first, combined configuration includes the first vaping device 810*a* magnetized to the second vaping device 810*b*. In this configuration or orientation, the mouthpiece 812*a* of the first vaping device 810*a* and the mouthpiece 812*b* of the second vaping device 812*b* may be simultaneously drawn by a user.

The vaping devices 810*a,b* can have any suitable shape and size. In some examples, each vaping device 810*a,b* has a body 820*a,b* with at least one substantially flat side 845*a,b* and a curved side 847*a,b* opposite the flat side 845*a,b*. The flat side 845*a,b* may be magnetized, or include magnets within or behind the flat side 845*a,b* such that the flat side 845*a,b* can be magnetized to another magnetic surface. In some examples, in the first, connected configuration, the substantially flat side 845*a* of the first vaping device 810*a* is magnetically connected to the substantially flat side 845*b* of the second vaping device 820*b*. The curved side 847*a* of the first vaping device 810*a* and the curved side 847*b* of the second vaping device 810*b* can form a unitary body having a substantially ovular shape.

The second, separated configuration can be achieved simply by removing one vaping device from the other vaping device. Or, if the user desired to keep the two vaping devices attached, but only use one at a time, a third, connected configuration includes the two vaping devices magnetized together and turned so that they are head-to-tail rather than head-to-head.

Figure 9:
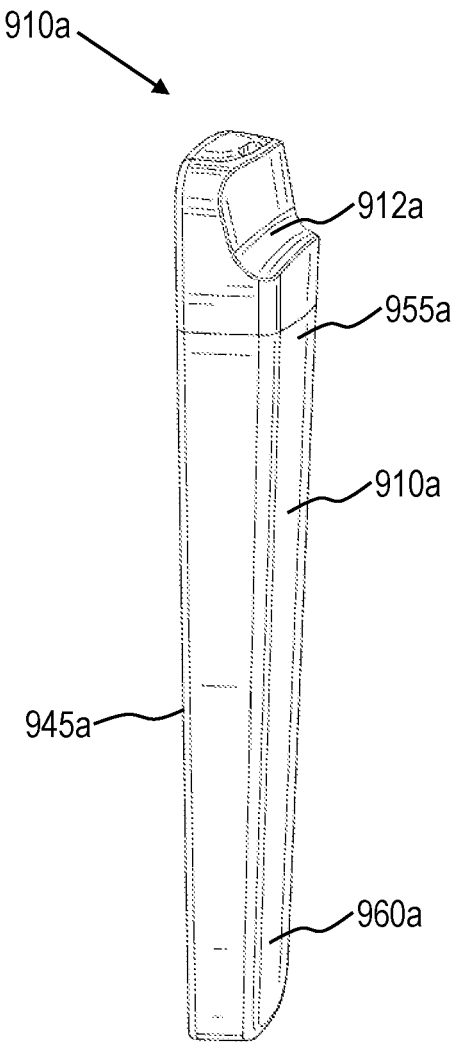
FIG. 9 is a perspective view of a vaping device according to various examples.
Figure 10:
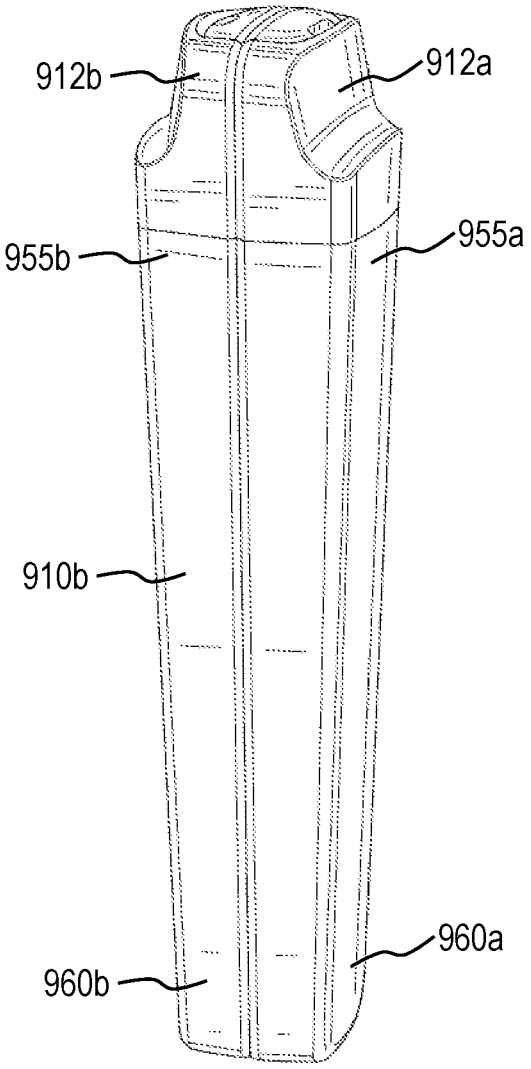
FIG. 10 is a perspective view of a vaping system in a connected configuration for simultaneous vaping according to various examples.
Figure 11:
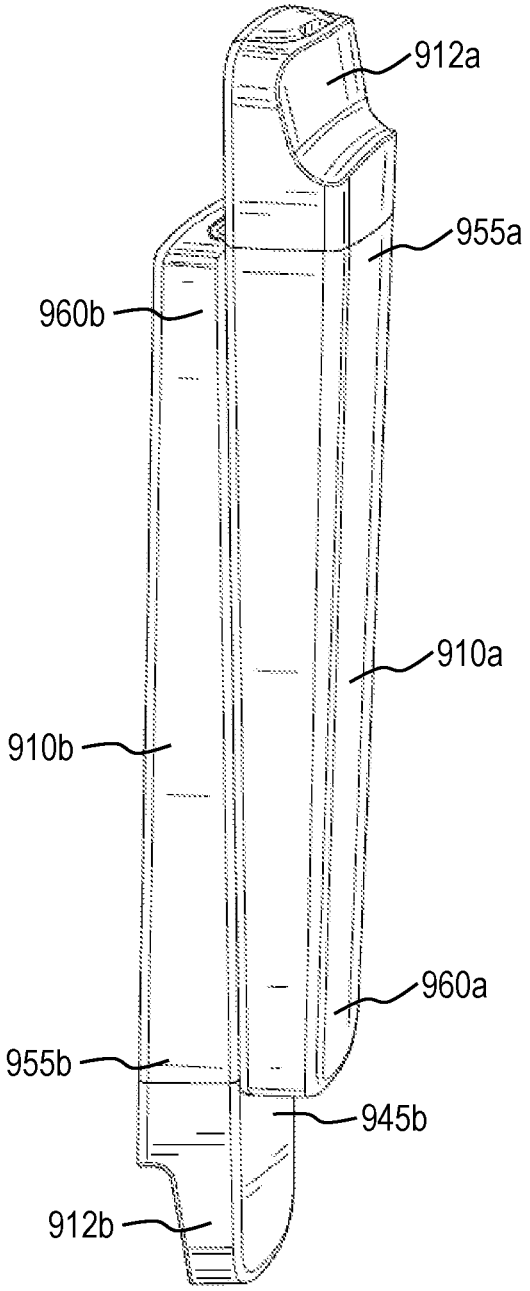
FIG. 11 is a perspective view of the vaping system of FIG. 10 in a connected configuration for separate vaping according to various examples.

FIGS. 9-11 illustrate another example of magnetically connectable vaping devices. Each vaping device 910*a,b* includes a magnetized side 945*a,b*. The vaping system 900 includes a first vaping device 910*a* with at least one magnetized side 945*a*, and a second vaping device 910*b* with at least one magnetized side 945*b*. Each vaping device 910*a,b* can include a body 920*a,b* with a first, proximal end 955*a,b* having a mouthpiece 912*a,b* coupled thereto and a second distal end 960*a,b*, with the distal end 960*a,b* opposite the proximal end 955*a,b*. The mouthpiece 912*a,b* can be connected or coupled to the proximal end 955*a,b*, or the mouthpiece 912*a,b* can be integral to the proximal end 955*a,b*.

A first, connected configuration (FIG. 10) allows a user to vape from both vaping devices 910*a,b* at the same time. That is, the mouthpiece 912*a* of the first vaping device 910*a* and a mouthpiece 912*b* of the second vaping device 910*b* can be simultaneously drawn by a user. A second, separated configuration is possible with the first vaping device 910*a* not connected to the second vaping device 910*b* (FIG. 9 illustrates first vaping device 910*a* in a second, separated configuration).

A third, connected configuration (FIG. 11) allows the first and second vaping devices 910*a,b* to be connected and separately vaped in a convenient manner. The first, proximal end 955*a* of the first vaping device 910*a* is connected to the second, distal end 960*b* of the second vaping device 910*b*.

Figure 12:
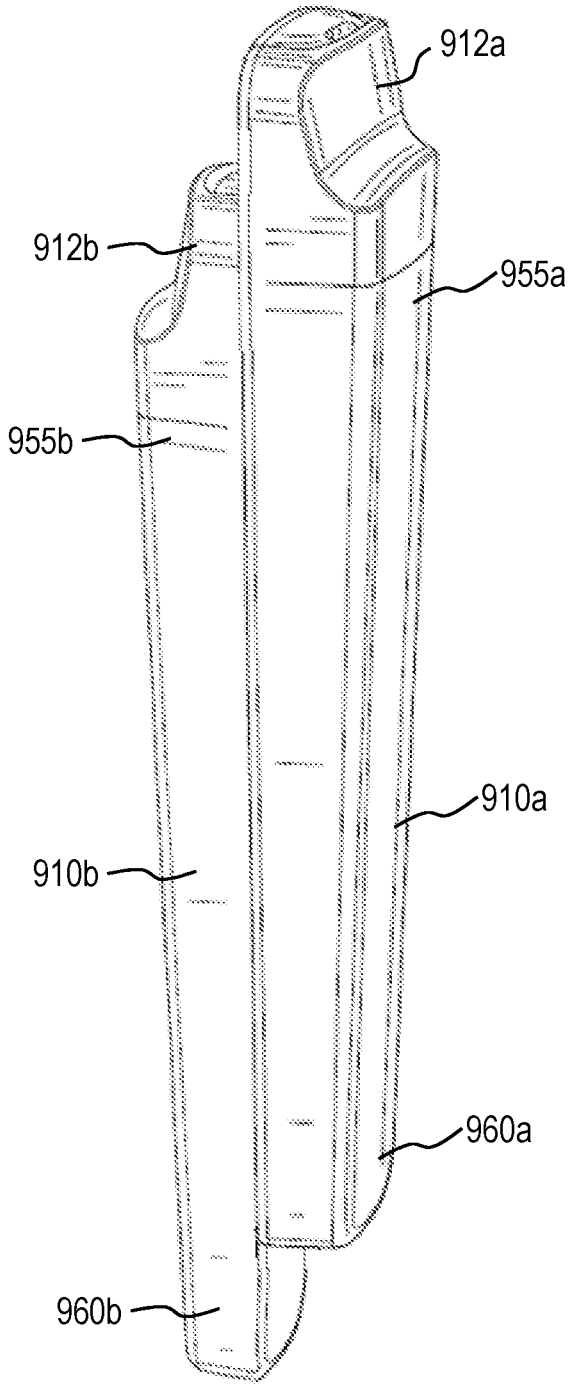
FIG. 12 is a perspective view of the vaping system of FIG. 10 in another exemplary connected configuration for separate vaping according to various examples.

Another exemplary connected configuration (FIG. 12) allows the first and second vaping devices 910*a,b* to be connected and separately vaped in a convenient manner. The mouthpiece 912*b* of the second vaping device 910*b* is connected to the proximal end 955*a* of the first vaping device 910*a*, such that the mouthpiece 912*b* is off-set or below the mouthpiece 912*a*.

While the vaping devices 910*a,b* in FIGS. 9-12 are generally described as being selectively attached via magnetic sides, any other suitable method of attachment can be used. For example, complementary voids and projections may be used to selectively attach vaping devices.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

Unless otherwise indicated, all numbers expressing measurements and quantities used in the specification and claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. In one embodiment, the terms "about," "approximately," and "substantially" refer to numerical parameters within 10% of the indicated range.

The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Specific embodiments disclosed herein may be further limited in the claims using consisting of or consisting essentially of language. Various aspects discussed in one drawing may be present and/or used in conjunction with the embodiment shown in another drawing, and each element shown in multiple drawings may be discussed only once. All statements herein reciting principles, aspects, and embodiments of the invention, as well as specific examples thereof, are intended to encompass equivalents thereof. The described features, structures, or characteristics of configurations of the invention may be combined in any suitable manner in one or more configurations.

As used in this specification and the appended claims, singular forms such as "a," "an," and "the" may include the plural unless the context clearly dictates otherwise. Thus, for example, reference to "a vapor outlet" may include one or more vapor outlets, and reference to "the vaping device" may include reference to one or more vaping devices.

As used herein, the term "substantially" refers to the complete or nearly complete extent or degree of an action, characteristic, property, state, structure, item, or result to function as indicated. For example, a void that is "substantially" open may be either completely open or nearly completely open. As used herein the term "generally" refers to something that is more of the designated adjective than not, or the converse if used in the negative. As used herein, a plurality of items, structural elements, compositional elements, and/or materials may be presented in a common list for convenience. However, these lists should be construed as though each member of the list is individually identified as a separate and unique member. Additionally, the word "connected" and "coupled" is used throughout for clarity of the description and can include either a direct connection or an indirect connection.

Although the foregoing disclosure provides many specifics, these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A vaping system comprising:

a first vaping device having a first mouthpiece;

a second vaping device having a second mouthpiece;

a connector connecting the first vaping device and the second vaping device in multiple configurations;

wherein the connector has a first configuration allowing the first vaping device to be connected to the second vaping device such that a proximal end of the first mouthpiece is adjacent to a proximal end of the second mouthpiece to allow a user to simultaneously draw from the first vaping device and the second vaping device; and wherein the connector has a second configuration allowing the first vaping device to be connected to the second vaping device such that the first mouthpiece is not adjacent to the second mouthpiece to allow the user to draw from the first vaping device and the second vaping device separately; and wherein the connector has a third configuration allowing the first vaping device to be connected to the second vaping device such that the first mouthpiece is not adjacent to the second mouthpiece to allow the user to draw from the first vaping device and the second vaping device simultaneously.

2. The vaping system of claim 1, wherein the connector has a fourth configuration disconnecting the first vaping device from the second vaping device.

3. The vaping system of claim 1, wherein the connector comprises at least one of:

a magnet, a slot, a friction fit connector, or a twist connector.

4. The vaping system of claim 1, wherein the connector is integral to a body of the first vaping device.

5. The vaping system of claim 4, wherein the connector is integral to a body of the second vaping device.

6. The vaping system of claim 5, wherein the body of the first vaping device comprises a substantially flat side in connection with a magnet, and wherein the body of the second vaping device comprises a substantially flat side in connection with a magnet.

7. The vaping system of claim 6, wherein, in the first configuration, the substantially flat side of the first vaping device is magnetically connected to the substantially flat side of the second vaping device.

8. The vaping system of claim 1, wherein in the first configuration to allow the user to simultaneously draw from the first vaping device and the second vaping device, the proximal end of the first vaping device is connected to the first, proximal end of the second vaping device; and wherein in the second configuration to allow the user to draw from the first vaping device and the second vaping device separately, the proximal end of the first vaping device is connected to a distal end of the second vaping device.

9. A vaping system comprising:

a first vaping device having a body extending between a first end and a second end, the first end having a mouthpiece;

wherein the body has a substantially planar side having a magnet for attaching the substantially planar side of the body to another surface;

wherein the first vaping device has a first configuration allowing the first vaping device to be connected to a second vaping device such that the first end having the mouthpiece is adjacent to a mouthpiece of the second vaping device;

wherein the first vaping device has a second configuration allowing the first vaping device to be connected to the second vaping device such that the first end having the mouthpiece is not adjacent to the mouthpiece of the second vaping device to allow a user to draw from the first vaping device and the second vaping device separately; and wherein the first vaping device has a third configuration allowing the first vaping device to be connected to the second vaping device such that the first end having the mouthpiece is not adjacent to the mouthpiece of the second vaping device to allow the user to draw from the first vaping device and the second vaping device simultaneously.

10. The vaping system of claim 9, wherein the second vaping device comprises a body extending between a first end and a second end, and wherein the magnet for attaching the substantially planar side of the body to another surface comprises a magnet for attaching the substantially planar side of the body to the second vaping device in multiple configurations.

11. The vaping system of claim 10, wherein the magnet has a first configuration allowing the first vaping device to be connected to the second vaping device such that the mouthpiece of the first vaping device is adjacent to the mouthpiece of the second vaping device to allow a user to simultaneously draw from the first vaping device and the second vaping device; and wherein the magnet has a second configuration allowing the first vaping device to be connected to the second vaping device such that the mouthpiece of the first vaping device is not adjacent to the mouthpiece of the second vaping device to allow the user to draw from the first vaping device and the second vaping device separately.

* * * * *